US007576331B2

(12) United States Patent
Allsworth et al.

(10) Patent No.: US 7,576,331 B2
(45) Date of Patent: Aug. 18, 2009

(54) UV GAS DISCHARGE TUBES

(75) Inventors: Max Daniel Allsworth, London (GB); Robert James Lade, Marlow (GB); Parviz James Monem, Guildford (GB)

(73) Assignee: Kidde IP Holdings Limited, Berkshire (GB)

( * ) Notice: Subject to any disclaimer, the term of this patent is extended or adjusted under 35 U.S.C. 154(b) by 523 days.

(21) Appl. No.: 11/221,234

(22) Filed: Sep. 7, 2005

(65) Prior Publication Data

US 2006/0049361 A1 Mar. 9, 2006

(30) Foreign Application Priority Data

Sep. 7, 2004 (GB) ..... 0419847.9

(51) Int. Cl.
*G01T 1/18* (2006.01)
*H01J 47/00* (2006.01)

(52) U.S. Cl. ..... 250/374

(58) Field of Classification Search ..... 250/374
See application file for complete search history.

(56) References Cited

U.S. PATENT DOCUMENTS 3,594,746 A * 7/1971 Pileika et al ..... 340/516
4,736,105 A 4/1988 Fonnesbeck
4,823,114 A 4/1989 Gotisar
5,026,272 A 6/1991 Takahashi et al.
5,194,728 A 3/1993 Peterson
5,227,640 A 7/1993 Nomura et al.

FOREIGN PATENT DOCUMENTS

DE 37 06 986 A1 9/1988

(Continued)

*Primary Examiner*—David P Porta
*Assistant Examiner*—Mark R Gaworecki
(74) *Attorney, Agent, or Firm*—Merchant & Gould P.C.

(57) ABSTRACT

In use of a UV gas discharge tube (such as used in flame monitoring apparatus), an electric field is periodically applied in the tube, each application of the field being followed by an 'off' period in which the field is removed. During this process, the mean value of the statistical lag $T_s$ is measured over a predetermined time duration (the statistical lag is the time lag after each application of the electric field to the tube before conduction (if any) takes place). If the statistical lag lies within region I, the flame is judged to be present. If the statistical lag lies in region II, the flame is judged to be off (and a warning may be signalled). If the statistical lag lies in region III, a fault in the tube is signalled. This may be a "field emission" fault whereby free electrons are generated by the applied electric field, without the presence of UV radiation or it may be a "multiple counting" fault. Here, contamination of the gas within the tube causes the time required to de-ionise the gas, when the electric field is removed, to be increased. A multiple counting fault may be confirmed by monitoring each conduction of the tube and checking whether there is an immediately following conduction. A multiple counting fault may also be checked by increasing the lengths of the 'off' periods of the electric field and checking whether the mean statistical lag increases. The use of a supplementary light source is also disclosed which periodically illuminates the tube to check whether it has become room-light sensitive—that is, sensitive to normal ambient light.

36 Claims, 3 Drawing Sheets

FOREIGN PATENT DOCUMENTS

| | | | |
|---|---|---|---|
| EP | 0 150 233 | | 8/1985 |
| EP | 0 274 275 | A2 | 7/1988 |
| GB | 1 515 116 | | 6/1978 |
| JP | 55-1547 | | 1/1980 |
| WO | WO 03091748 | A1 * | 11/2003 |

* cited by examiner

UV GAS DISCHARGE TUBES

TECHNICAL FIELD

The invention relates to improvements in and relating to UV (ultra-violet) gas discharge tubes. UV gas discharge tubes may be used in a variety of different applications where their response to ultra-violet radiation is used for detection and warning purposes, for example. Embodiments of the invention to be described in more detail below by way of example only are concerned with the detection of failure modes which are known to occur in such tubes. More specifically, a UV gas discharge tube can be used to monitor ultra-violet radiation emitted by the flame of a gas burner, so as to detect the absence or reduction of this radiation in the event of cessation of the flame (a "flame-out" condition), and thereupon shutting off the supply of gas to the burner. In such an application, it is necessary to detect failures in the detection process, particularly types of failure where the tube falsely continues to indicate the presence of UV radiation.

BRIEF SUMMARY OF THE INVENTION

According to the invention, there is provided apparatus for detecting a condition in which an ultra-violet gas discharge tube becomes sensitive to radiation in another wavelength band, comprising means for temporarily directing radiation in the other wavelength band to the tube, and means for monitoring for any resultant increase in the output of the tube.

According to the invention, there is further provided an ultra-violet gas discharge tube arrangement, comprising means operative during each of a succession of periods (on periods) to apply an electric field to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, control means responsive to any conduction of the tube during each of a plurality of the on periods for producing an output dependent on the mean value (mean lag value) of the lags within each of those on periods before any conduction takes place, first output means operative when the output indicates that the mean lag value lies within a predetermined range to indicate emission of the ultra-violet radiation from the source, second output means operative when the output indicates that the mean lag value is greater than the said range for indicating absence of emission of UV radiation from the source, and fault responsive means operative when the output indicates that the mean lag value is less than the predetermined range to indicate a fault condition in which conduction takes place within the tube without the presence of UV radiation.

According to the invention, there is also provided an ultra-violet gas discharge tube arrangement, comprising means operative during each of a succession of periods (on periods) to apply an electric field to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, control means responsive to any conduction of the tube during each of a plurality of the on periods for producing an output dependent on the mean value (mean lag value) of the time lags within each of those on periods before any conduction takes place, first output means operative when the output indicates that the mean lag value lies within a predetermined range to indicate emission of the ultra-violet radiation from the source, second output means operative when the output indicates that the mean lag value is greater than the said range for indicating absence of emission of UV radiation from the source, and fault detecting means comprising means operative during a test duration to produce a predetermined and temporary increase in the length of the off periods and means operative in the event that the mean lag value increases during that test duration whereby to indicate the existence of a fault condition in which the normal length of the off periods is insufficient to allow the tube to return to the quiescent state.

According to the invention, there is still further provided a method for detecting a condition in which an ultra-violet gas discharge tube becomes sensitive to radiation in another wavelength band, including the step of temporarily directing radiation in the other wavelength band to the tube, and monitoring for any resultant increase in the output of the tube.

According to the invention, there is yet further provided a method of operating an ultra-violet gas discharge tube arrangement, comprising the steps of applying an electric field during each of a succession of periods (on periods) to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, responding to any conduction of the tube during each of a plurality of the on periods for producing an output dependent on the mean value (mean lag value) of the time lags within each of those on periods before any conduction takes place, indicating emission of the ultra-violet radiation from the source when the output indicates that the mean lag value lies within a predetermined range, indicating absence of emission of UV radiation from the source when the output indicates that the mean lag value is greater than the said range, and indicating a fault condition in which conduction takes place within the tube without the presence of UV radiation when the output indicates that the mean lag value is less than the predetermined range.

According to the invention, there is also provided a method of operating an ultra-violet gas discharge tube arrangement, comprising the steps of applying an electric field during each of a succession of periods (on periods) to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, responding to any conduction of the tube during each of a plurality of the on periods for producing an output dependent on the mean value (mean lag value) of the time lags within each of those on periods before any conduction takes place, indicating emission of the ultra-violet radiation from the source when the output indicates that the mean lag value lies within a predetermined range, indicating absence of emission of UV radiation from the source when the output indicates that the mean lag value is greater than the said range, producing a predetermined and temporary increase in the length of the off periods during a test duration, and indicating the existence of a fault condition in which the normal length of the off periods is insufficient to allow the tube to return to the quiescent condition in the event that the mean lag value increases during that test duration.

BRIEF DESCRIPTION OF THE DRAWINGS

Apparatus and methods according to the invention for detecting and signalling the failure of a UV gas discharge tube will now be described, by way of example only, with reference to the accompanying diagrammatic drawings in which.

In the drawings, like elements are generally designated by the same reference numerals.

MODES OF CARRYING OUT THE INVENTION

UV gas discharge tubes comprise a pair of electrodes (cathode and anode) enclosed within a housing, the housing being filled with a suitable gas. A voltage difference is applied across the electrodes to create a field within the tube. Upon irradiation of the tube by ultra-violet radiation, the incident energy can cause the emission of a surface electron from the cathode into the gas. In the presence of the applied electric field within the tube, the emitted photoelectron can cause electrical breakdown within the gas by collision with gas molecules, secondary emission from the cathode by UV radiation from the discharge, and ion bombardment, thereby creating a current flow in the tube from the cathode to the anode. The process is inherently very inefficient with only 1 in $10^4$ incident photons causing photocell conduction. The probability is affected by the cathode material, the gas type, the gas pressure and the applied electric field.

Once in a conducting state, the tube will remain in conduction until the externally applied voltage is removed. After a certain period with the voltage removed, the charged species in the gas recombine and the gas becomes non-conducting again. Upon re-application of the voltage, the time elapsing from that re-application until conduction through the gas occurs again depends on the level of the ultra-violet radiation, the sensitivity of the gas discharge tube, and Poisson statistics (owing to the large number of photons involved in generating a single photoelectron). This elapsed time is known as the "statistical lag", $T_s$.

Figure 1:
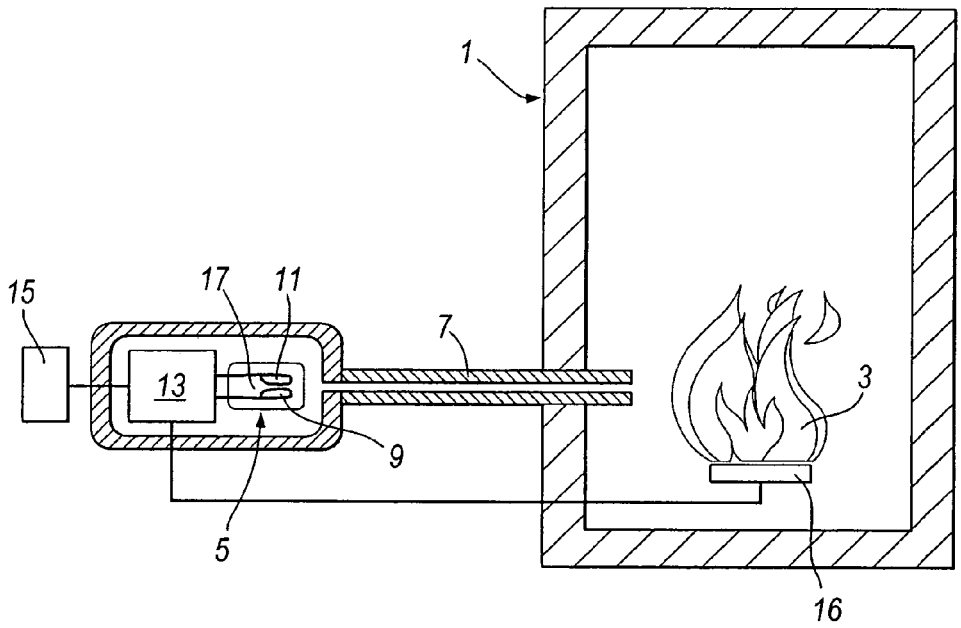
FIG. 1 is a schematic sectional view of a UV gas discharge tube as used to monitor the presence or otherwise of a burning flame in a burner.

FIG. 1 shows a UV gas discharge tube of this type being used to monitor the presence of a burning flame 3 within a burner 1. The tube is indicated diagrammatically at 5, comprising its two electrodes 9 and 11 and the gas 17. UV radiation from the flame 3 is directed to the tube 5 through a sight tube 7.

In operation, a predetermined voltage is periodically applied between the electrodes 9 and 11. A control unit 13 detects whether a current flows between the electrodes after each application of the applied voltage and measures the elapsed time (the "statistical lag", $T_s$) between each application of the applied voltage and the resultant conduction in the tube. After each application of the voltage, the voltage is then removed for a sufficient length of time so that (in normal operation of the tube) the charged species in the gas recombine and conduction stops, so that on re-application of the voltage no conduction occurs in the absence of UV radiation.

Figure 2:
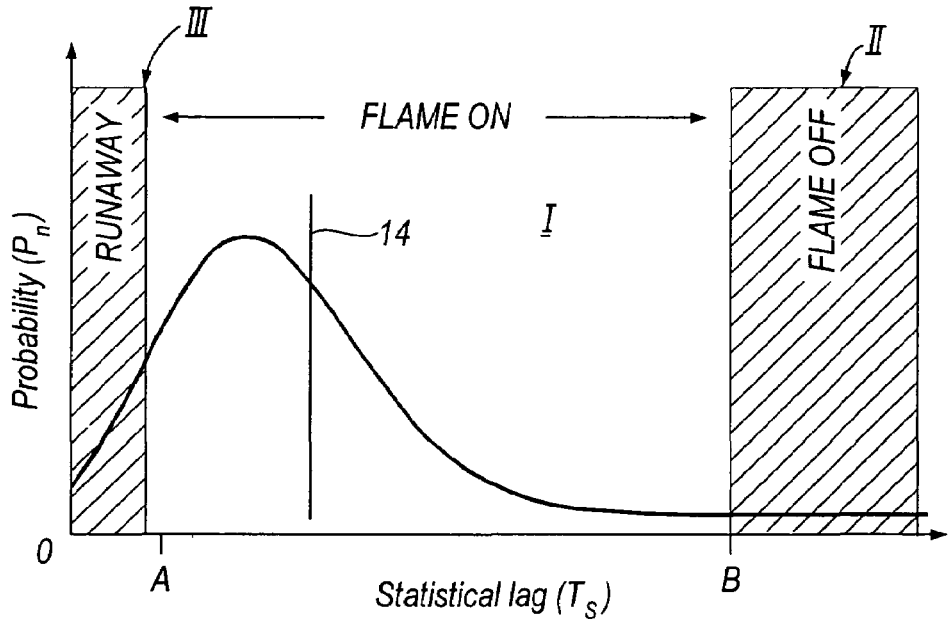
FIG. 2 is a graph of the time lag ("statistical lag" $T_s$) between the application of a voltage across the electrodes of the UV tube and the tube becoming conductive against the probability ($P_n$) that the tube will conduct, this graph showing the operation of the tube in the presence of the flame.
Figure 3:
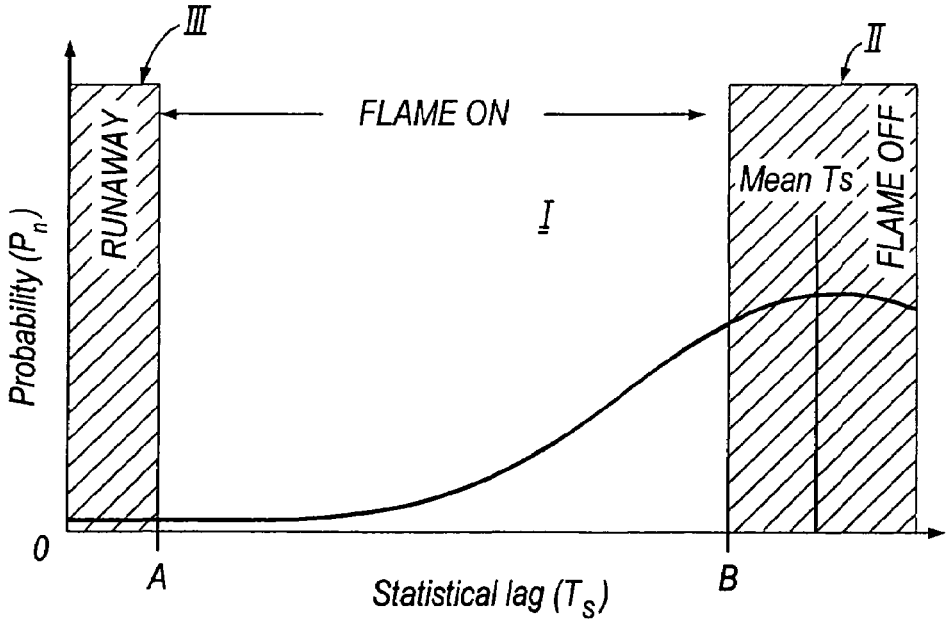
FIG. 3 corresponds to FIG. 2 but shows the corresponding situation in the event of absence of the flame.

During operation, the control unit 13 produces an output signal representing the mean value of the statistical lag over a predetermined number of voltage applications. One method of carrying this out is to count the number of conductions of the tube which occur within a predetermined time period (e.g. 125 milliseconds). The reciprocal of the number of counts is thus representative of the mean statistical lag over this period. As shown in FIG. 2, in the presence of the flame 3 there is a high probability that the statistical lag will lie between the values A and B in the region I and the mean value of the statistical lag will therefore normally lie within this region, such as shown at 14. In the event of failure of the flame 3, there will be a reduction or substantial cessation of UV falling on the tube and the probability is high, therefore, that the statistical lag will lie above the point B. The mean value of $T_S$ will therefore normally lie in the region II as shown in FIG. 3. This is detected by the control unit 13 which can signal a warning on a control panel 15 and shut off the supply of gas to the burner 16 to prevent build-up of fuel and a possible explosion.

In practice, various faults or failures can occur in the tube. One possible fault occurs when the tube becomes insensitive to UV radiation. This is often caused by partial or complete loss of gas within the envelope of the tube, normally caused by leakage. This stops the tube conducting in the presence of UV radiation. Clearly, in such a case the control unit 13 would respond by signalling a flame-out (because the mean value of the statistical lag $T_s$ would become very high). This is a fail-safe fault.

However, other fault modes can occur which are "fail-dangerous"—that is, each such fault mode causes the tube to conduct or to continue to conduct even though incident UV radiation is absent. Various types of fail-dangerous faults can occur and the apparatus being described is arranged to detect them and signal a warning.

One such fault mode results in the tube becoming sensitive to longer wavelength radiation not specific to the presence of a flame (that is, sensitive to "room light"—the ambient light in the region of the tube). This fault is often caused by contamination of the cathode material, which lowers the work function of the material, causing the tube to conduct in the absence of the flame 3. Therefore, in such a case the control unit 13 would continue to assume that the flame 3 is present and thus continue to allow the supply of gas to the burner 16. This fault mode may be gradual, with the tube becoming more sensitive to longer wavelength radiation over an extended period of time.

Figure 4:
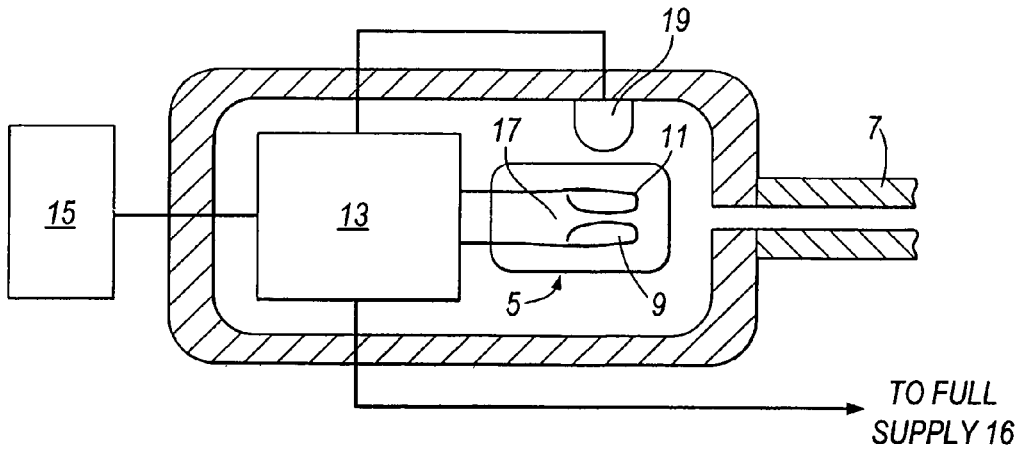
FIG. 4 is a schematic cross-section of part of FIG. 1 but showing it modified to detect one type of failure of the tube.

In order to detect such a fault mode, the apparatus of FIG. 1 is modified, as shown in FIG. 4, by the incorporation of a longer wavelength light source 19 which may be a light-emitting diode (LED), a quartz halogen bulb, or any other suitable source of intense long wavelength radiation (longer than, say, 300 nm). By means of the light source 19, the tube 5 is periodically illuminated with long wavelength radiation during operation, each such test period of illumination lasting typically a few seconds, and being controlled by the control unit 13. During each such test period, the control unit 13 monitors the level of its output signal (that is, the mean statistical lag $T_s$). If the tube has become room-light sensitive, the value of $T_s$ will decrease (that is, the tube behaves as though it is receiving additional UV radiation. In this way, the control unit 13 can detect the fault and a suitable warning can be given. Because this fault mode develops gradually, it is envisaged that it will be necessary to carry out the test only infrequently (e.g. every few hours).

It is also possible for the tube to enter a "field emission" state whereby free electrons are generated by the applied electric field, without the presence of UV radiation. This fault mode is also fail-dangerous because the tube reacts in the same way as it does in the presence of UV radiation. This fault mode can occur as a result of surface roughening of the cathode material caused by ion bombardment. The resultant high points on the cathode surface will experience electrical field enhancement, resulting in the field emission effect. This fault mode is commonly referred to as "runaway".

Figure 5:
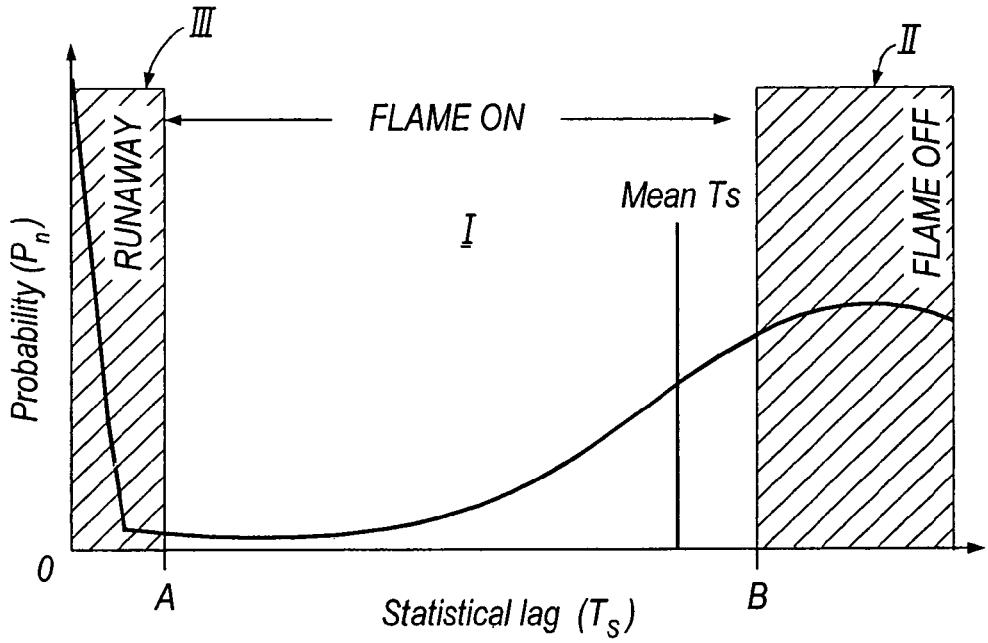
FIG. 5 corresponds to FIGS. 2 and 3 but shows the graph in the presence of another type of failure of the tube.

Clearly, in the presence of a field emission fault, the tube will go into conduction substantially immediately the electric field is applied across the electrodes. Therefore, the mean value for the statistical lag $T_s$ will be very short and will lie within region I as shown in FIG. 5. Therefore, if the control unit 13 detects that the mean value of $T_s$ lies within this region, it will signal a field-emission fault by means of a suitable warning signal.

In situations in which the tube is being used to monitor a very intense flame 3, the emitted ultra-violet radiation will be correspondingly intense and will thus result in a correctly operating tube producing very short values for $T_s$. It could thus become difficult to distinguish between a tube with a field emission fault and a correctly operating tube detecting high values of UV radiation. In order to deal with this potential problem, the value of the voltage applied across the electrodes (and thus the strength of the electric field) is selected, during initial set-up, so that under all values of UV radiation likely to be produced by the flames being monitored, the mean value of $T_s$ will lie within region II. This ensures that if the intensity of the flame increases significantly from that observed during scanner commissioning, the signal level is such that the mean $T_s$ generated will not become too short to compromise checking the integrity of the tube.

Another type of fault mode which can occur is a "multiple counting" fault. Here, contamination of the gas within the tube causes the de-ionisation of the gas to be increased. In other words, the length of the "off" periods between the application of the voltage across the electrodes is no longer sufficient to ensure that all the charged species in the gas have dissipated after its conduction. Therefore, when the voltage is next applied across the electrodes, the tube immediately re-conducts even in the absence of UV radiation. This again is fail-dangerous. This fault mode can occur gradually, initially becoming evident when a single conduction of the photocell becomes recorded as two counts. This has the effect of increasing the number of conductions for the same level of UV radiation. As contamination of the gas increases, a single photo-conduction of the cell leads to multiple counts until, eventually, a continuous pulse train is produced, again being termed "runaway". Thus, the effect again is that the mean statistical lag will lie within the region I (FIG. 5).

In order to detect this fault mode, and to enable it to be distinguished over a field-emission fault, the control unit 13 not only measures the mean value of $T_S$ but also carries out interrogation of each individual conduction. This enables an abnormally high number of conductions with short $T_s$ to be identified, and thus the potentially dangerous situation to be signalled as a fault.

Instead, however, a multiple-counting fault mode could be detected by periodically increasing the lengths of the periods for which the voltage applied across the tube electrodes is off. Such a time increase will reduce or eliminate the multiple counting effect (by providing sufficient time for the charged species in the gas to dissipate) and will thus increase the mean value of the statistical lag detected by the control unit 13. If such a reduced signal level is detected during the increased "off" periods, this will be indicative of a multiple counting fault and a suitable warning can be signalled. Of course, this increase in the lengths of the off periods will cause a corresponding decrease in the length of the periods for which the applied voltage is on, causing a corresponding reduction in signal level (even in the absence of a multiple counting fault). The control unit will be arranged to take this reduction in signal level into account.

If the control unit detects a multiple counting fault (by either of the methods described above), then it could be arranged to cause a re-setting of the lengths of the off periods (within a set limit or by a predetermined amount)—that is, not merely a period in increase in the lengths of the off periods for fault detection purposes but in continuing increase. This would then enable the tube to operate correctly (i.e. it will overcome the multiple counting fault), and safe operation would thus continue. The control unit could then indicate a non-critical fault condition so that the tube would be replaced at the next maintenance inspection. Testing for multiple counting would of course continue so as to detect a worsening situation in which the increase in the length of the "off" periods was insufficient to overcome the multiple counting fault.

In practice, the apparatus and the control unit 13 will be arranged to be able to detect the existence of any one or all of the three different types of "fail-dangerous" faults described.

The invention claimed is:

1. Apparatus for detecting a condition in which a gas discharge tube has acquired sensitivity to radiation in a wavelength band non-specific to radiation generated by a source intended to be sensed, comprising means for intermittently applying voltage to electrodes in the tube and temporarily directing additional radiation in the wavelength band non-specific to radiation generated by the source intended to be sensed to the tube, and means for monitoring time elapsing from each application of the voltage until conduction through gas occurs and analyzing the elapsed times to identify whether the gas discharge tube has acquired sensitivity.

2. Apparatus according to claim 1, wherein the radiation of the wavelength band non-specific to radiation generated by a source intended to be sensed includes light of wavelength longer than 300 nm.

3. Apparatus according to claim 1, wherein the means for intermittently applying the voltage to the electrodes in the tube applies the voltage at intervals having a first predetermined frequency, and further comprising means for monitoring an output of the tube during those intervals to detect the presence of ultra-violet radiation from the source of ultra-violet radiation, wherein the means for temporarily directing the additional radiation in the wavelength band non-specific to radiation generated by the source intended to be sensed to the tube directs it thereto during intervals having a much lower frequency than the first predetermined frequency.

4. Apparatus according to claim 3, wherein the source of ultra-violet radiation is a flame of a burner and including means responsive to a change in the output of the tube following reduction in the ultra-violet radiation received by the tube to produce a control signal signifying failure of the flame.

5. Apparatus according to claim 4, including means operative in response to the control signal to shut off a fuel supply to the burner.

6. Apparatus according to claim 1, wherein the means for temporarily directing the additional radiation in the wavelength band non-specific to radiation generated by the source intended to be sensed to the tube comprises a light-emitting diode or a quartz halogen bulb.

7. Apparatus according to claim 1, which is part of flame monitoring equipment for detecting absence of a flame.

8. An ultra-violet gas discharge tube arrangement, comprising means operative during each of a succession of periods (on periods) to apply an electric field to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, control means responsive to any conduction of the tube during each of a plurality of the on periods for producing an output dependent on the mean value (mean lag value) of the lags within each of those on periods before any conduction takes place, first output means operative when the output indicates that the mean lag value lies within a predetermined range to indicate emission of the ultra-violet radiation from the source, second output means operative when the output indicates that the mean lag value is greater than the said range for indicating absence of emission of UV radiation from the source, and fault responsive means operative when the output indicates that the mean lag value is less than the predetermined range to indicate a fault condition in which conduction takes place within the tube without the presence of UV radiation.

9. Arrangement according to claim 8, in which the fault responsive means includes means operative when the output indicates that the mean lag value is less than the predetermined range to detect conduction of the tube during two successive ones of the on periods, whereby to produce an indication that the fault condition is a condition in which the length of the off periods is insufficient to allow the tube to reach the quiescent state.

10. Arrangement according to claim 9, including means responsive to the condition that the length of the off periods is insufficient to allow the tube to reach the quiescent state to produce a predetermined increase in the length of the off periods whereby to remove the fault condition unless and until the predetermined increase is insufficient to allow the tube to return to the quiescent condition during the off periods.

11. Arrangement according to claim 8, in which the control means comprises means for counting the number of conductions of the tube during a predetermined plurality of the on periods whereby to produce the output in dependence on the reciprocal of the resultant count.

12. Arrangement according to claim 8, in which the source is a burner the burning flame of which emits the ultra-violet radiation, and in which the second output means includes means operative to shut off a fuel supply to the burner.

13. An ultra-violet gas discharge tube arrangement, comprising means operative during each of a succession of periods (on periods) to apply an electric field to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, control means responsive to any conduction of the tube during each of a plurality of the on periods for producing an output dependent on the mean value (mean lag value) of the time lags within each of those on periods before any conduction takes place, first output means operative when the output indicates that the mean lag value lies within a predetermined range to indicate emission of the ultra-violet radiation from the source, second output means operative when the output indicates that the mean lag value is greater than the said range for indicating absence of emission of UY radiation from the source, and fault detecting means comprising means operative during a test duration to produce a predetermined and temporary increase in the length of the off periods and means operative in the event that the mean lag value increases during that test duration whereby to indicate the existence of a fault condition in which the normal length of the off periods is insufficient to allow the tube to return to the quiescent state.

14. Arrangement according to claim 13, in which the control means comprises means for counting the number of conductions of the tube during a predetermined plurality of the on periods whereby to produce the output in dependence on the reciprocal of the resultant count.

15. Apparatus according to claim 13, in which the source is a burner the burning flame of which emits the ultra-violet radiation, and in which the second output means includes means operative to shut off a fuel supply to the burner.

16. A method for detecting a condition in which an ultra-violet gas discharge tube becomes sensitive to radiation in a wavelength band non-specific to radiation generated by a source intended to be sensed, the method comprising:

intermittently applying voltage to electrodes in the tube;

temporarily directing additional radiation in the wavelength band non-specific to radiation generated by a source intended to be sensed to the tube;

monitoring time elapsing from each application of the voltage until conduction through gas occurs; and analyzing the elapsed times to identify whether the gas discharge tube has acquired sensitivity.

17. A method according to claim 16, wherein the radiation of the wavelength band non-specific to radiation generated by a source intended to be sensed includes light of wavelength longer than 300 nm.

18. A method according to claim 16, wherein intermittently applying voltage to electrodes in the tube comprises applying voltage to electrodes in the tube at intervals having a first predetermined frequency; wherein the method further comprises monitoring an output of the tube during those intervals to detect the presence of ultra-violet radiation from the source of ultra-violet radiation; wherein temporarily directing the radiation in the wavelength band non-specific to radiation generated by the source intended to be sensed to the tube directs it thereto during intervals having a much lower frequency than the first predetermined frequency.

19. A method according to claim 18, in which the source of ultra-violet radiation is the flame of a burner and including the step of responding to a change in output of the tube following reduction in the ultra-violet radiation received by the tube to produce a control signal signifying failure of the flame.

20. A method according to claim 19, including the step of shutting of a fuel supply to the burner in response to the control signal.

21. A method according to claim 16, wherein temporarily directing the radiation in the second wavelength band to the tube is carried out using a light-emitting diode or a quartz halogen bulb.

22. A method according to claim 16, wherein the gas discharge tube is used for detecting absence of a flame in flame monitoring equipment.

23. A method of operating an ultra-violet gas discharge tube arrangement, comprising the steps of applying an electric field during each of a succession of periods (on periods) to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, responding to any conduction of the tube during each of a plurality of the on periods for producing an output dependent on the mean value (mean lag value) of the time lags within each of those on periods before any conduction takes place, indicating emission of the ultra-violet radiation from the source when the output indicates that the mean lag value lies within a predetermined range, indicating absence of emission of UV radiation from the source when the output indicates that the mean lag value is greater than the said range, and indicating a fault condition in which conduction takes place within the tube without the presence of UV radiation when the output indicates that the mean lag value is less than the predetermined range.

24. A method according to claim 23, including the step of detecting conduction of the tube during two successive ones of the on periods when the mean lag value has been determined to be less than the predetermined range, whereby to produce an indication of a fault condition in which the length of the off periods is insufficient to allow the tube to reach the quiescent state.

25. A method according to claim 24, including the step of responding to the condition that the length of the off periods is insufficient to allow the tube to reach the quiescent state by producing a predetermined increase in the length of the off periods whereby to remove the fault condition unless and until the predetermined increase is insufficient to allow the tube to return to the quiescent condition.

26. A method according to claim 23, in which the step of producing the output dependent on the mean lag value is carried out by counting the number of conductions of the tube during a predetermined plurality of the on periods whereby to produce the output in dependence on the reciprocal of the resultant count.

27. A method according to claim 23, in which the source is a burner the burning flame of which emits the ultra-violet radiation, and including the step of shutting off a fuel supply to the burner when the output indicates that the mean lag value is greater than the said range.

28. A method according to claim 23, in which the source is a burner the burning flame of which emits the ultra-violet radiation, and including the step of shutting off a fuel supply to the burner when the output indicates that the mean lag value is greater than the said range.

29. A method of operating an ultra-violet gas discharge tube arrangement, comprising the steps of applying an electric field during each of a succession of periods (on periods) to and within a UV gas discharge tube while the tube is exposed to a source from which ultra-violet radiation may be emitted so that conduction of the tube may take place during those periods, each on period being followed by a period (off period) in which the electric field is absent and during which in normal operation of the tube it returns to or maintains a quiescent state, responding to any conduction of the tube during each of a plurality of the on periods for producing an output dependent on the mean value (mean lag value) of the time lags within each of those on periods before any conduction takes place, indicating emission of the ultra-violet radiation from the source when the output indicates that the mean lag value lies within a predetermined range, indicating absence of emission of UV radiation from the source when the output indicates that the mean lag value is greater than the said range, producing a predetermined and temporary increase in the length of the off periods during a test duration, and indicating the existence of a fault condition in which the normal length of the off periods is insufficient to allow the tube to return to the quiescent condition in the event that the mean lag value increases during that test duration.

30. A method according to claim 29, in which the step of producing the output dependent on the mean lag value is carried out by counting the number of conductions of the tube during a predetermined plurality of the on periods whereby to produce the output in dependence on the reciprocal of the resultant count.

31. Apparatus for detecting a condition in which a gas discharge tube has acquired sensitivity to radiation in a wavelength band non-specific to radiation generated by a source intended to be sensed, the apparatus comprising:

means for temporarily directing radiation in the wavelength band non-specific to radiation generated by a source intended to be sensed to the tube;

means for monitoring for any resultant increase in the output of the tube;

means for periodically applying an electric field within the tube at intervals having a predetermined frequency and while the tube is exposed to a source of ultra-violet radiation; and means for monitoring the output of the tube during those intervals to detect the presence of ultra-violet radiation from the source, and in which the means for temporarily directing the radiation in the wavelength band non-specific to radiation generated by a source intended to be sensed to the tube directs it thereto during intervals having a much lower frequency.

32. Apparatus according to claim 31, in which the source of ultra-violet radiation is the flame of a burner and including means responsive to a change in output of the tube following reduction in the ultra-violet radiation received by the tube to produce a control signal signifying failure of the flame.

33. Apparatus according to claim 32, including means operative in response to the control signal to shut off a fuel supply to the burner.

34. A method for detecting a condition in which an ultra-violet gas discharge tube becomes sensitive to radiation in a wavelength band non-specific to radiation generated by a source intended to be sensed, the method comprising:

temporarily directing radiation in the wavelength band non-specific to radiation generated by a source intended to be sensed to the tube;

monitoring for any resultant increase in the output of the tube;

periodically applying an electric field within the tube at intervals having a predetermined frequency and while the tube is exposed to a source of ultra-violet radiation; and monitoring the output of the tube during those intervals to detect the presence of ultra-violet radiation from the source; and wherein temporarily directing the radiation in the wavelength band non-specific to radiation generated by a source intended to be sensed to the tube comprises directing the radiation in the wavelength band non-specific to radiation generated by a source intended to be sensed to the tube during intervals having a much lower frequency.

35. A method according to claim 34, wherein the source of ultra-violet radiation is the flame of a burner and, wherein the method further comprises responding to a change in output of the tube following reduction in the ultra-violet radiation received by the tube to produce a control signal signifying failure of the flame.

36. A method according to claim 35, further comprising shutting of a fuel supply to the burner in response to the control signal.

* * * * *

UNITED STATES PATENT AND TRADEMARK OFFICE

CERTIFICATE OF CORRECTION

PATENT NO. : 7,576,331 B2
APPLICATION NO. : 11/221234
DATED : August 18, 2009
INVENTOR(S) : Allsworth et al.

It is certified that error appears in the above-identified patent and that said Letters Patent is hereby corrected as shown below:

Col. 7, line 65, claim 13: "emission of UY radiation" should read --emission of UV radiation--

Signed and Sealed this

Fifth Day of January, 2010

David J. Kappos

David J. Kappos
*Director of the United States Patent and Trademark Office*